US007374520B1

(12) United States Patent
Licari

(10) Patent No.: US 7,374,520 B1
(45) Date of Patent: May 20, 2008

(54) ATHLETE POSITIONER FOR INCREASING SWING SPEED AND STRENGTH

(75) Inventor: Paul A. Licari, 57 Fifers La., Boxborough, MA (US) 01719-2130

(73) Assignee: Paul A. Licari, Boxborough, MA (US)

( * ) Notice: Subject to any disclaimer, the term of this patent is extended or adjusted under 35 U.S.C. 154(b) by 287 days.

(21) Appl. No.: 10/969,707

(22) Filed: Oct. 20, 2004

Related U.S. Application Data

(60) Provisional application No. 60/513,087, filed on Oct. 21, 2003.

(51) Int. Cl.
*A63B 26/00* (2006.01)

(52) U.S. Cl. ..... 482/144; 482/145

(58) Field of Classification Search ..... 482/144, 482/143, 69

See application file for complete search history.

(56) References Cited

U.S. PATENT DOCUMENTS 3,082,262 A * 3/1963 Scott ..... 524/429
4,135,714 A * 1/1979 Hughes ..... 482/127
4,229,002 A * 10/1980 Masters ..... 482/94
4,243,219 A * 1/1981 Price ..... 482/103
5,082,262 A * 1/1992 Sanchez ..... 473/458
5,156,402 A * 10/1992 Hart ..... 473/229
5,158,299 A * 10/1992 Otter ..... 473/229
5,228,684 A * 7/1993 Levatino ..... 473/457
5,269,512 A * 12/1993 Crowson et al. ..... 473/457
5,284,464 A * 2/1994 Lee et al. ..... 482/121
5,318,291 A * 6/1994 Levatino ..... 473/453
5,390,415 A * 2/1995 Momose ..... 30/41
5,390,915 A 2/1995 Levatino
5,582,403 A * 12/1996 George ..... 473/424
6,468,192 B1 * 10/2002 Doerscheln ..... 482/142
6,592,502 B1 * 7/2003 Phillips ..... 482/143

OTHER PUBLICATIONS

Unknown Author, "Inversion System" Internet Catalog www.sportsmanguide.com, USA.
Unknown Author, "Back-A-Traction Inversion Table" Internet Catalog www.relaxtheback.com, USA.

* cited by examiner

*Primary Examiner*—Lori Amerson

(57) ABSTRACT

An exercise method and apparatus means for increasing swing speed and swing strength of sporting and self defense implements, by supporting an athlete, while swinging the implements, in a range of angles that take advantage of the direct downward acceleration due to gravity. Comprised of a rigid human support, and a stationary base of sufficient height, with the means of securing the angle with respect to the gravitational acceleration, the athlete swings an implement just as he would standing vertical, in an attitude off vertical to make the most of increasing forces on the implement being swung.

1 Claim, 16 Drawing Sheets

ATHLETE POSITIONER FOR INCREASING SWING SPEED AND STRENGTH

CROSS REFERENCE TO RELATED APPLICATIONS

This application claims the benefit of Provisional Patent Application Ser. No. 60/513,087 filed 2003 Oct. 21 by the present inventor.

FEDERALLY SPONSORED RESEARCH

Not Applicable.

SEQUENCE LISTING OR PROGRAM

Not Applicable

BACKGROUND OF THE INVENTION

1. Field of Invention

This invention generally relates to exercise methods and exercise machines, specifically to methods and machines for improving swing speed and swing strength of sports and self defense implements.

2. Prior Art

Previously swing exercise methods and machines apply resistive forces to handles by the means of tethers and linkages connected to free weights and other resistive force elements. This invention uses the actual implement to be swung and repositions the complete athlete to angles advantageous for exercising the swing muscles. This invention makes drastic improvements over its predecessors.

A swinging implement tethered to a cable with tension makes the swing awkward and unlike actual circumstances as in U.S. Pat. No. 5,582,403 to George, 1996 Dec. 10. Forces with erratic magnitude and direction result due to the cable's limitation to apply only a concentrated, point, tensile load in the direction of the cable path. The direction of the force from the cable does not match the desired path of the mechanics of the human body. Multiple, unhelpful, components of the forces act on the implement, in multiple directions outside the desired swing path. Stretch and inertia of the cable add to the awkward feel at the implement grip as it improperly influences the natural motion through the athlete's arms.

A swinging implement connected to free weights, or other resistance means, via linkages and linear slides produces erratic, inconsistent forces that only follow the restrictive path of the machine as in U.S. Pat. No. 5,156,402 to Hart, 1992 Oct. 20 and U.S. Pat. No. 5,228,684 to Levatino, 1993 Jul. 20. The static coefficient of friction, acting on all the moving parts, results in a significantly greater start up resistance than the dynamic coefficient of friction, once the motion is started. The varying inertia of all the moving parts, the variation of fits and tolerances, lubricants and surface conditions, and variations in the mechanical properties of the base materials all add up to erratic motion and inconsistent resistive forces.

The desired smooth fluid swing along a path established by each person's body mechanics is replaced by choppy resistance along a restrictive course. Poor technique and unnecessary stress on the body can result.

The resistance created using this invention is smooth and repeatable because it is based on gravity and the mass of the implement. The athlete is working against forces due to the direct downward acceleration due to gravity, and the implement's inertia, not erratic, intermittent friction of pulleys, gears, sliding and translating mechanisms. Additionally, the path of motion follows the natural mechanics of the human body and in no way is restricted. This is important because each person's body is unique and it enables the swing motion to be the athlete's own individual technique. The motion is not limited or restricted in any way, enabling the user to swing freely without a preset path. Motion can be smooth and fluid, possibly avoiding injury that can result from sudden, jerky or intermittent force variations.

The batter uses his actual bat or implement, not a part of the machine. The batter gets accustomed to the grip and feel of his bat so the experience is closer to reality.

The new invention is more versatile. It can be applied in all sports or other activities, such as defense mechanisms, that require swinging an instrument or tool. It accepts a down-to-up swing, as in golf and hockey, overhead up-to-down swing as in a tennis serve, and side-to-side swing as in baseball.

The new invention is portable, lightweight, and economical and assembly is quick and easy.

OBJECTS AND ADVANTAGES

At the heart of hitting a baseball, or in any sport or activity involving a swinging implement, is the impact between bat and ball, racquet and ball etc. In all impacts the faster the objects are moving, and the greater the mass of the objects, the more energy involved in the collision. Therefore, the faster the implement is traveling and the larger the mass of the implement, the more energy available to be transferred to the ball or other projectile.

Accordingly, several objects and advantages of my invention are;

1) To enable a player to exercise to increase implement speed and implement size by positioning the player off vertical, towards the horizontal, so the plane of the swing is more vertical. When the implement is swung in this position the forces due to gravity act against the implement and provide resistance in a direction that is productive. This resistance can be changed by changing the angle or adding or reducing implement mass or adding a mass to the implement.

2) To enable a player to isolate and exercise muscle groups specific to swinging an implement.

3) To enable a player to position himself to work on steps of a swing that have been identified as needing improvement, such as start-up force to overcome bat inertia, wrist snap or wrist torque on contact, and overall stroke speed.

4) To make the device portable so training can be accomplished at home, at the playing field, at the gym, or other suitable exercise space. The device can be set up quickly, in most cases in less than 5 minutes.

5) To make the device affordable so training can be accomplished by most anyone. Current machines are comprised of many parts, can be very expensive, and usually are only affordable to whole teams and fitness organizations.

6) To exercise the swing muscles safely and smoothly without the added stress of choppy, erratic resistive forces.

Further objects and advantages will become apparent from a consideration of the drawings and ensuing description.

SUMMARY

In accordance with the present invention a exercise method and apparatus means to increase swing speed and swing strength by suspending a human at sufficient height, providing a support structure that maintains a swing path without obstruction, and positioning said human off vertical, whereby the human can swing an implement, in a manner just as he would standing vertical, at an attitude off vertical, to make the most of the forces on the implement being swung.

DRAWINGS

Figures

1. FIG. 1A is a perspective of an athlete mounting the positioning device.

$F$=(mass of the implement)×(gravitational acceleration)=force on the implement.

Figure 1A:
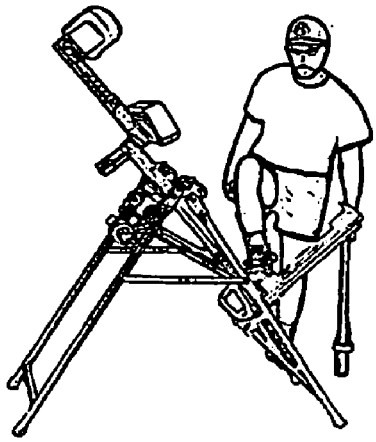
FIG. 1B is a perspective of an athlete rotated to an exercise position, lying in a lateral position, and working the muscles used in swinging. This view schematically displays the Center of Rotation of the athletes swing and the Center of Rotation of the body support with respect to the base.
FIG. 1C is a perspective schematically displaying the force due to gravitational acceleration on the implement being swung, in this case a baseball bat.
Figure 1B:
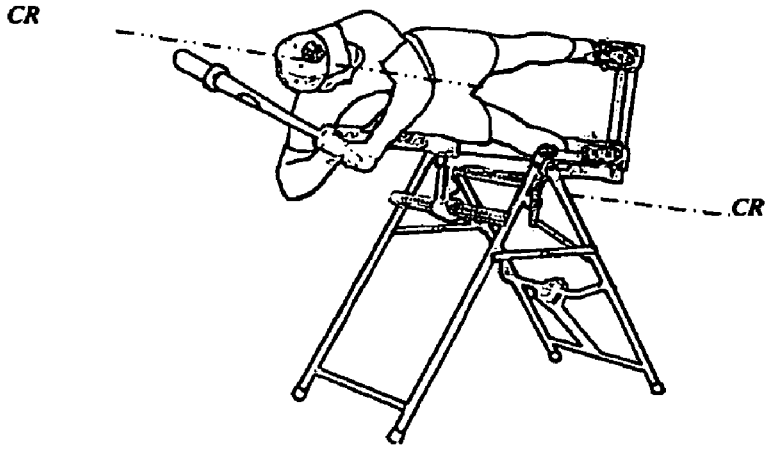
Figure 1C:
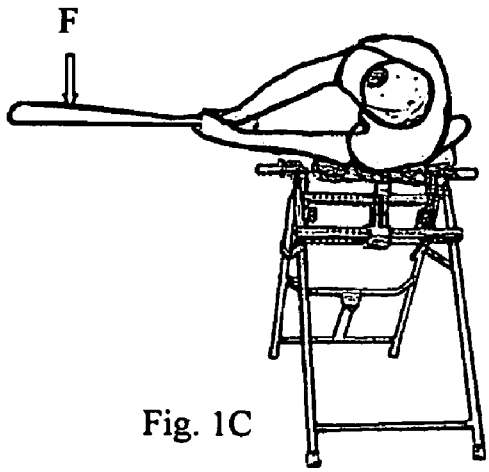
Figure 1D:
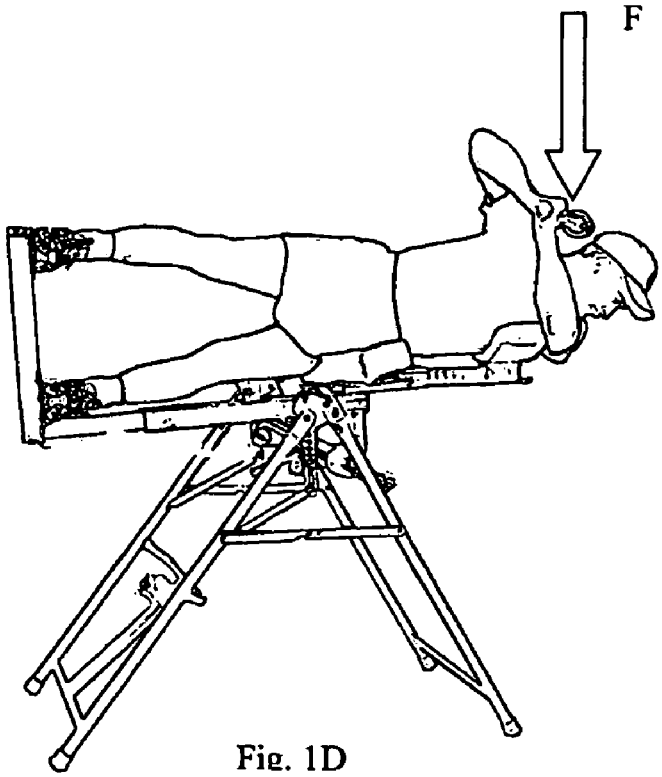

FIG. 1D is a side view perspective of an athlete working at getting a quick start of bat start-up inertia.

Figure 1E:
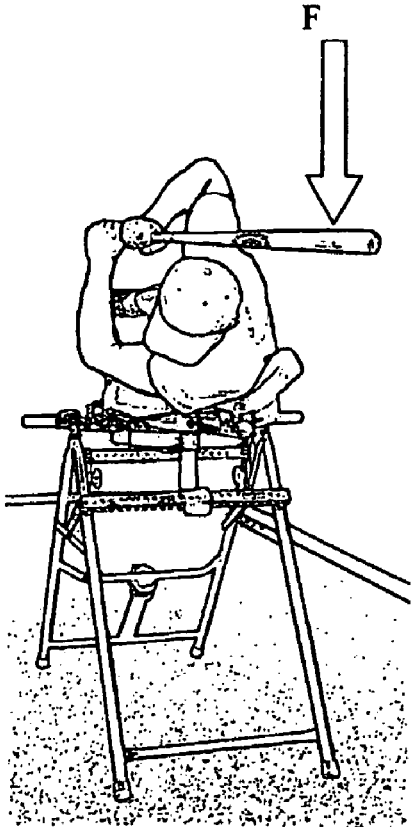

FIG. 1E is an end view perspective of an athlete working at getting a quick start of bat start-up inertia.

Figure 2:
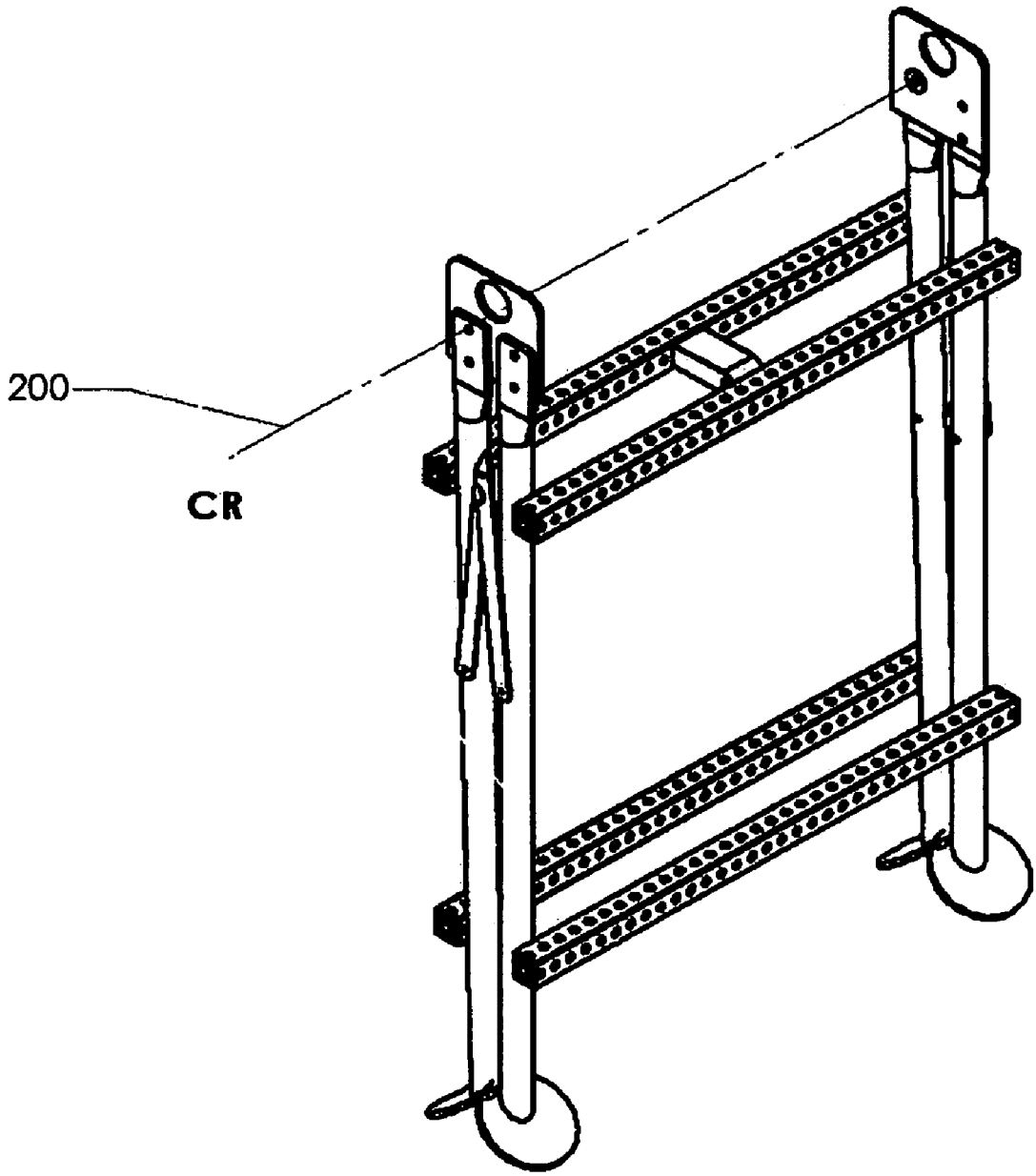

2. FIG. 2 is an isometric view of the Base Structure in the folded condition schematically showing the CR, Center of Rotation of the folding axis.

Figure 3:
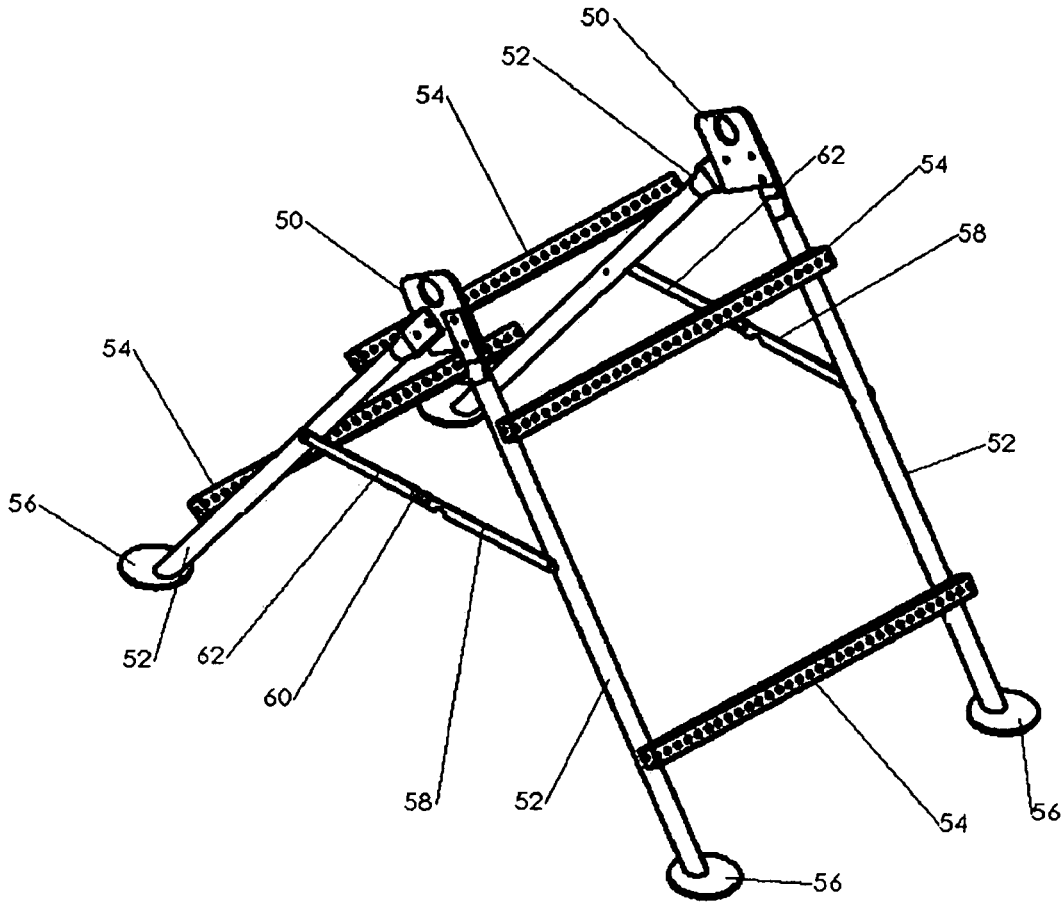

3. FIG. 3 is an isometric view of the Base Structure in the unfolded condition.

Figure 4:
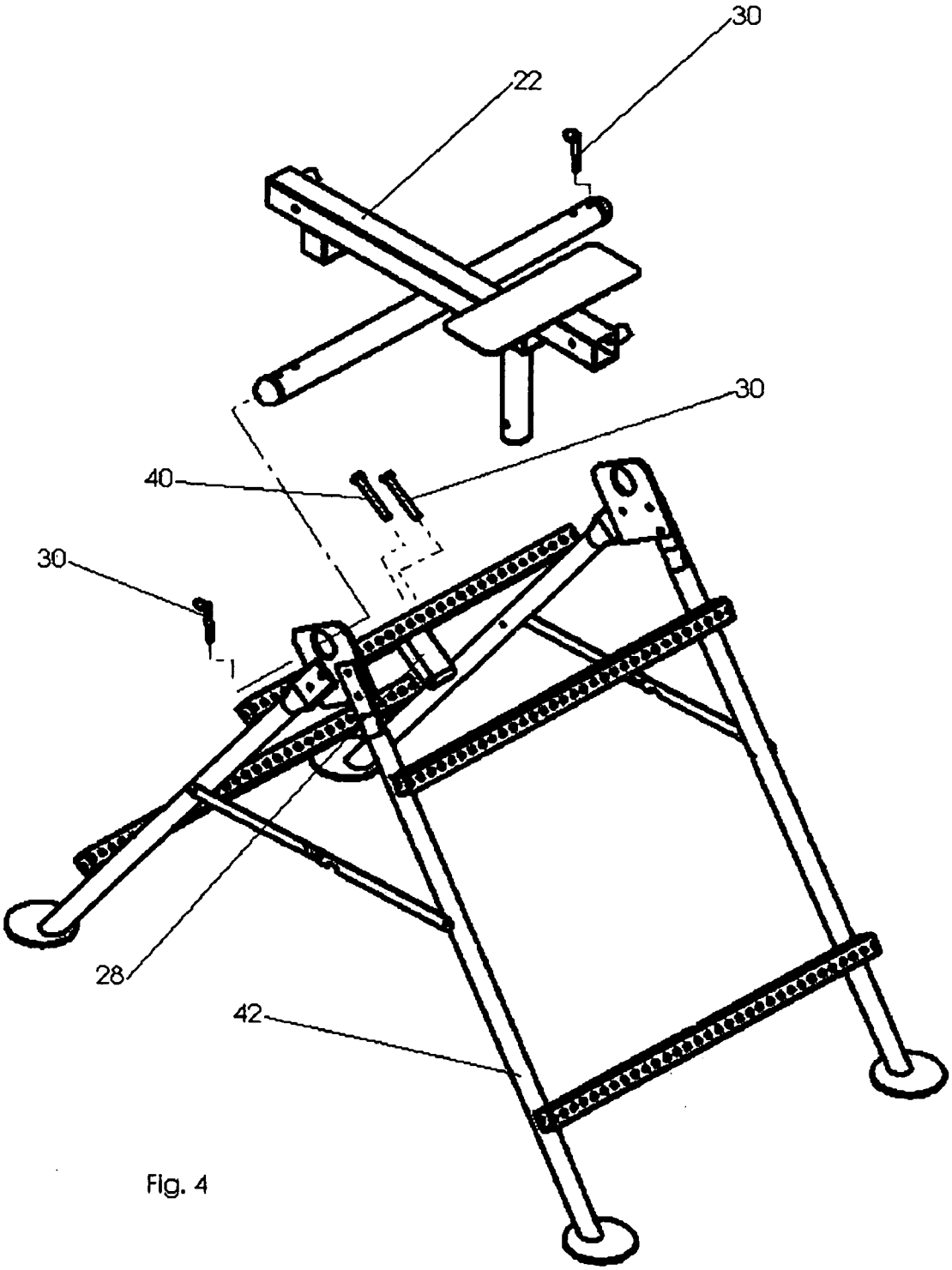

4. FIG. 4 is an isometric exploded view detailing how the Base Structure attaches to the Hip Support.

Figure 5:
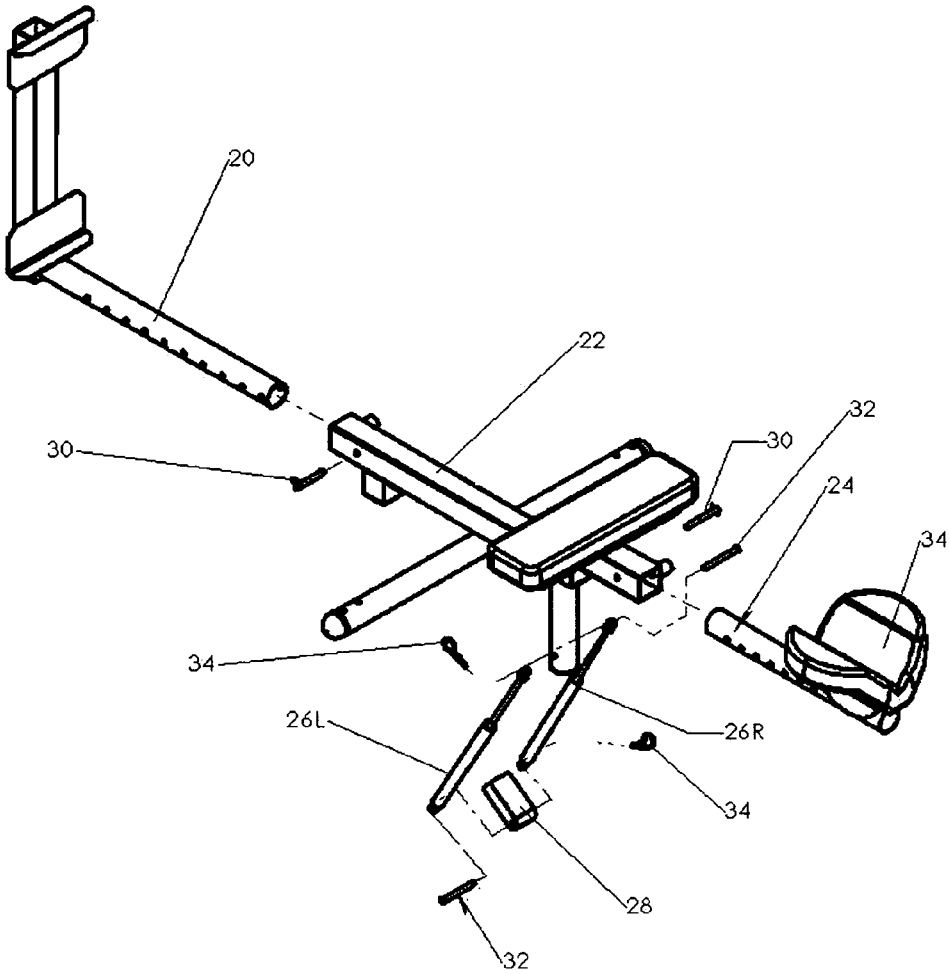

5. FIG. 5 is an isometric exploded view detailing how the Telescoping Foot Support and the Telescoping Chest Support attach to the Hip Support. Also the hydraulic cylinders, that supply the controlled rate of rotation, are shown.

Figure 6:
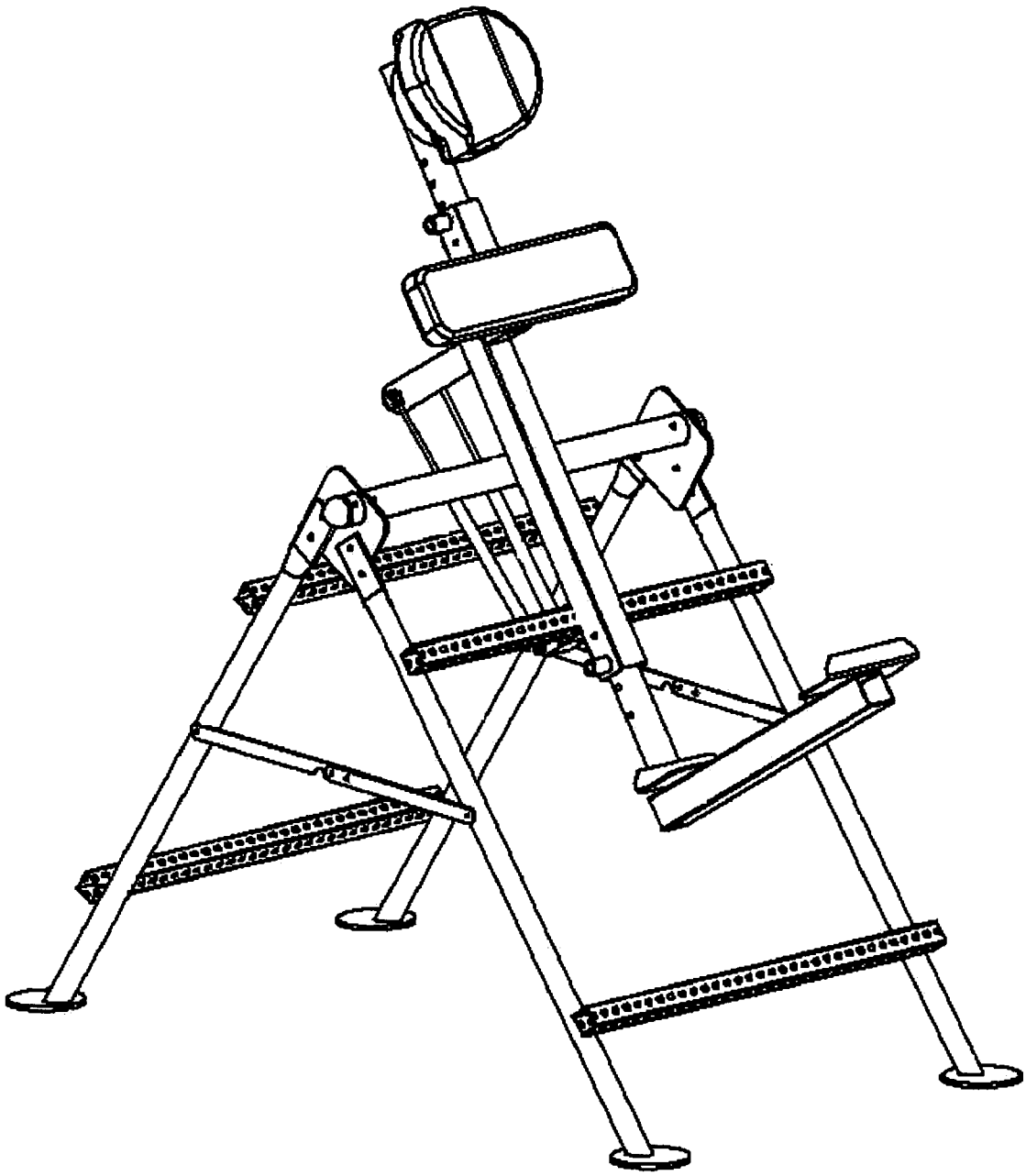

6. FIG. 6 is a perspective view of the fully assembled device at the starting position.

Figure 7:
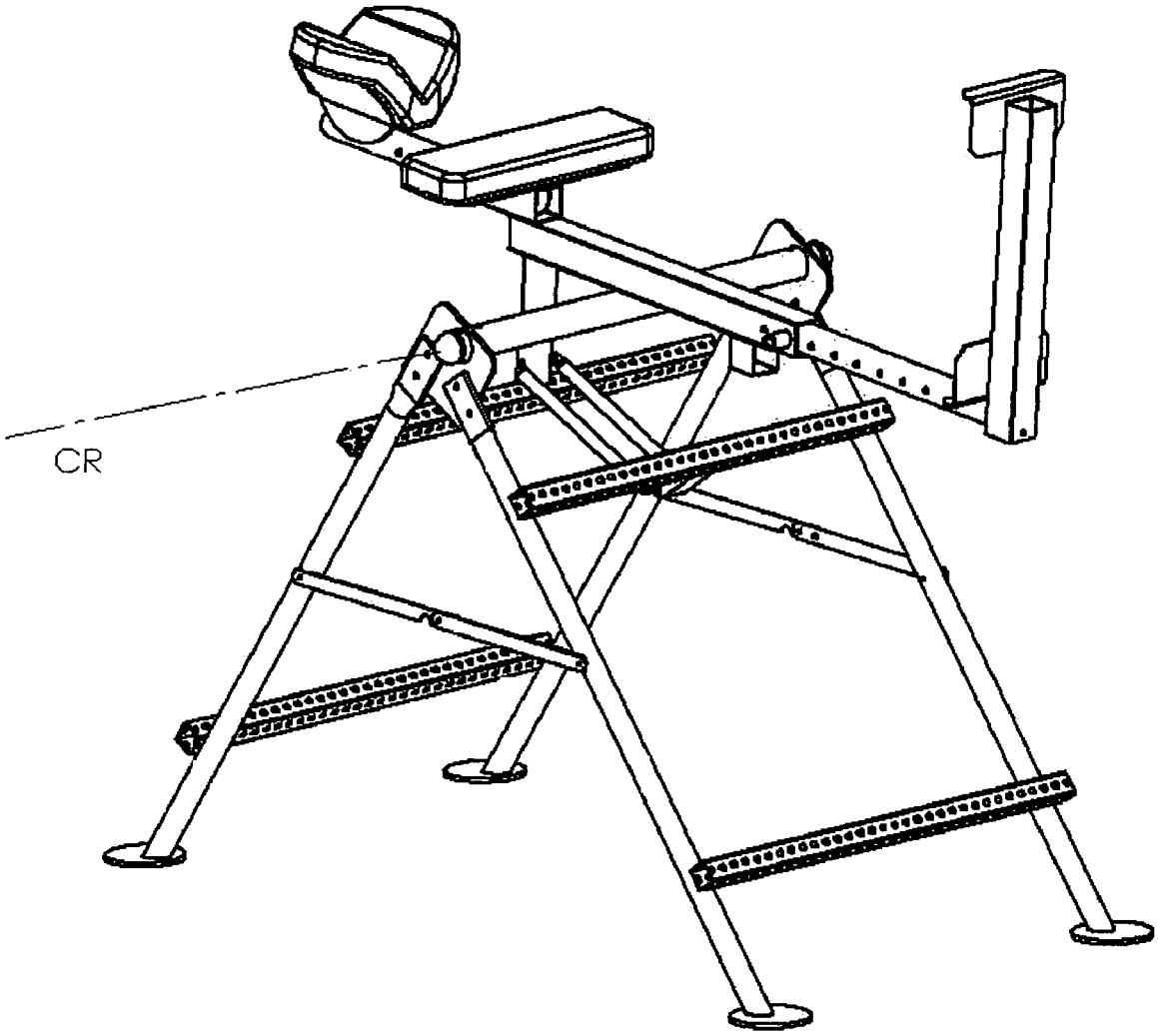

7. FIG. 7 is a perspective view of the device at maximum horizontal rotation exercise position.

Figure 8:
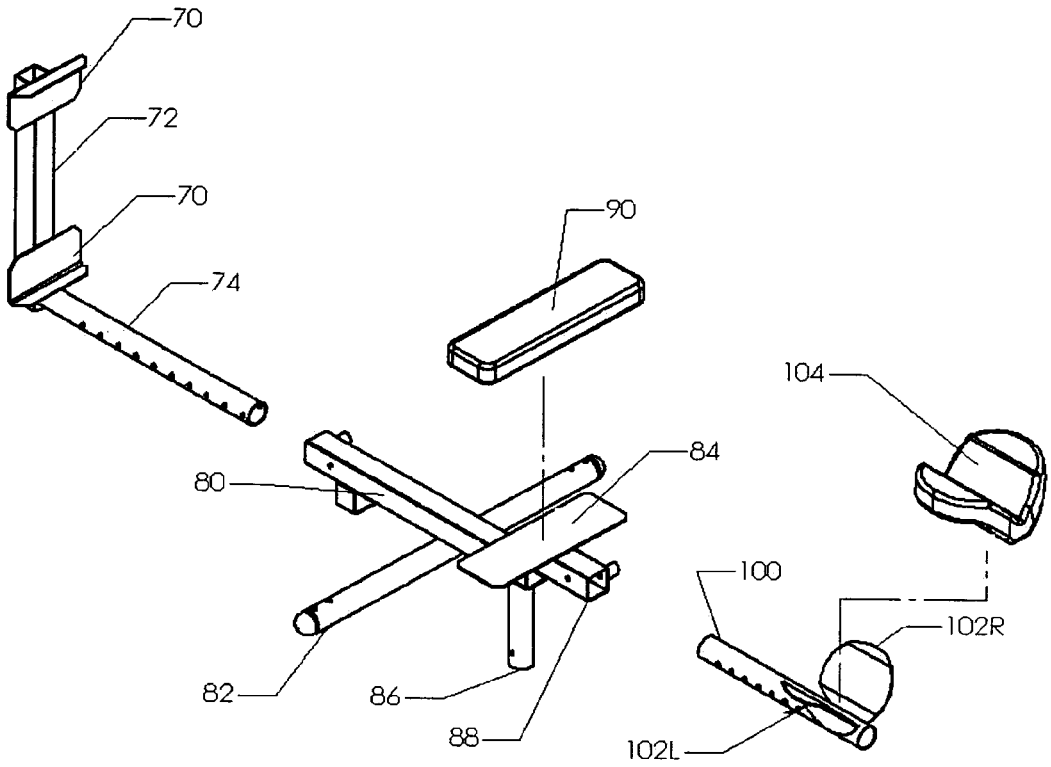

8. FIG. 8 is a perspective view labeling the components of the Foot Support, Hip Support, and the Chest Support.

Figure 10A:
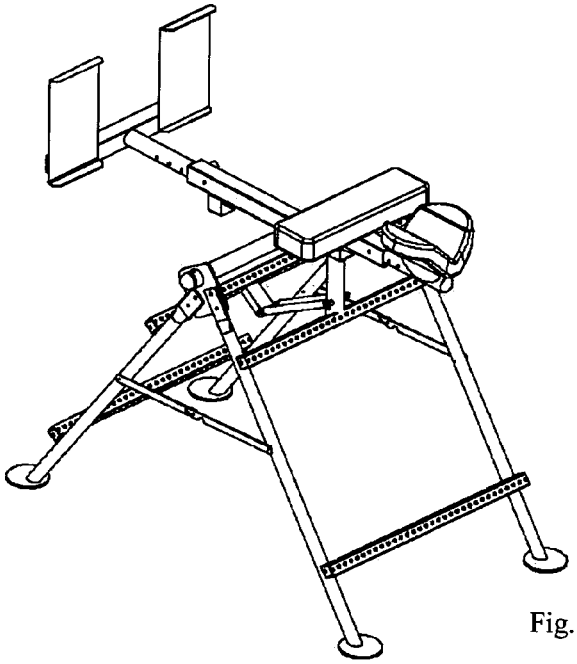
Figure 10B:
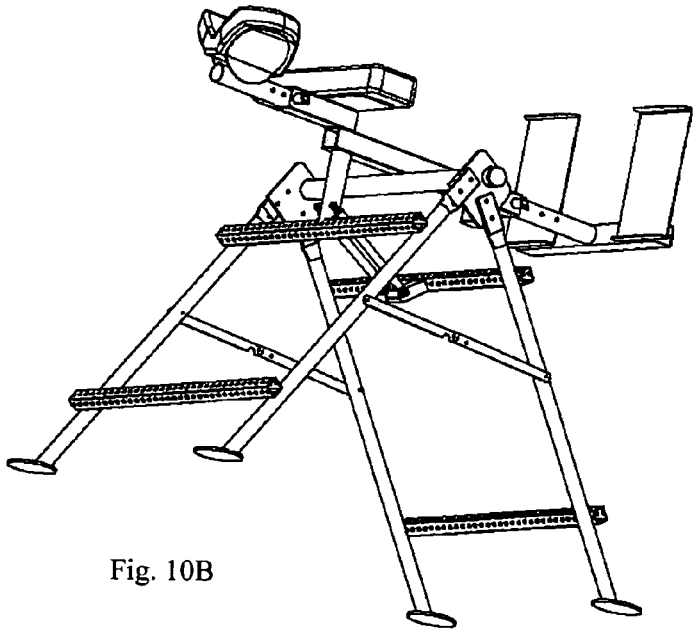

9. FIG. 10A is a perspective view showing an additional embodiment of a foot support at 90° for overhead swinging. FIG. 10B is a perspective bottom view of the same.

Figure 12A:
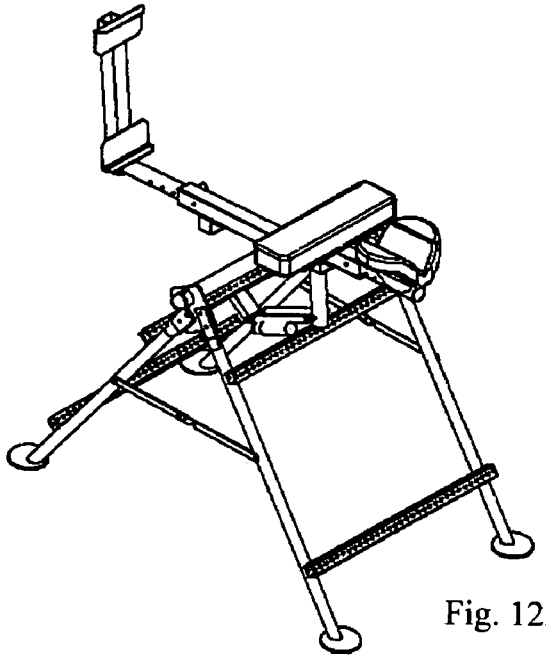
Figure 12B:
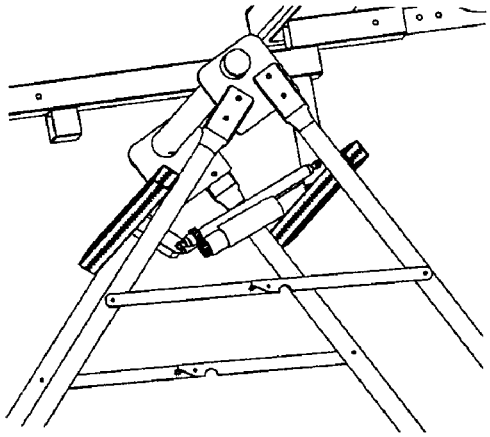
Figure 12C:
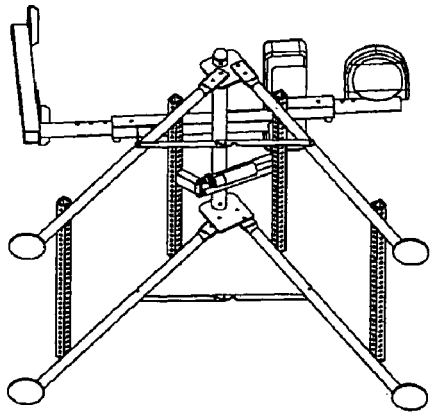

10. FIG. 12A is a perspective view showing an alternative embodiment of an electric motor added in place of the hydraulic cylinders to control the angle. FIGS. 12B and 12C are perspective views of the same at different angles for clarity.

Figure 14A:
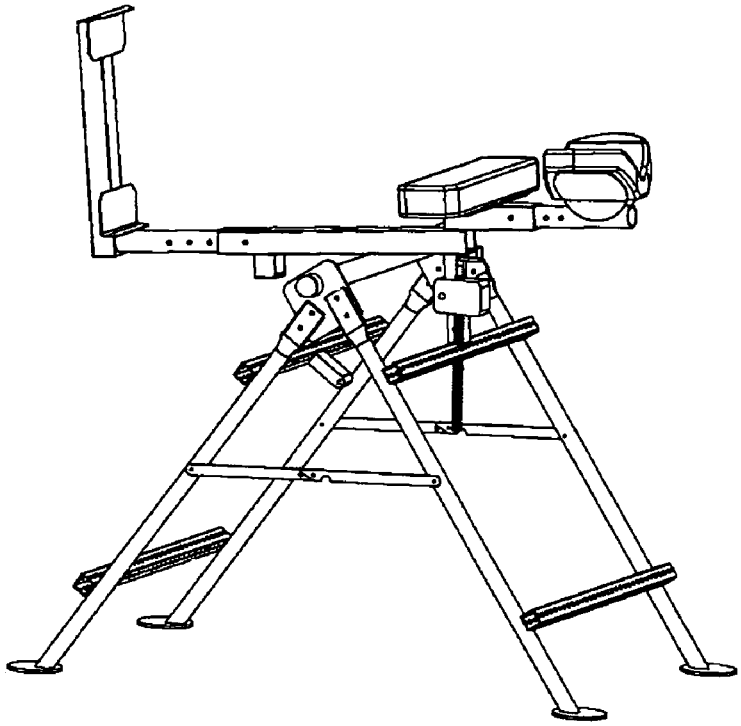
Figure 14B:
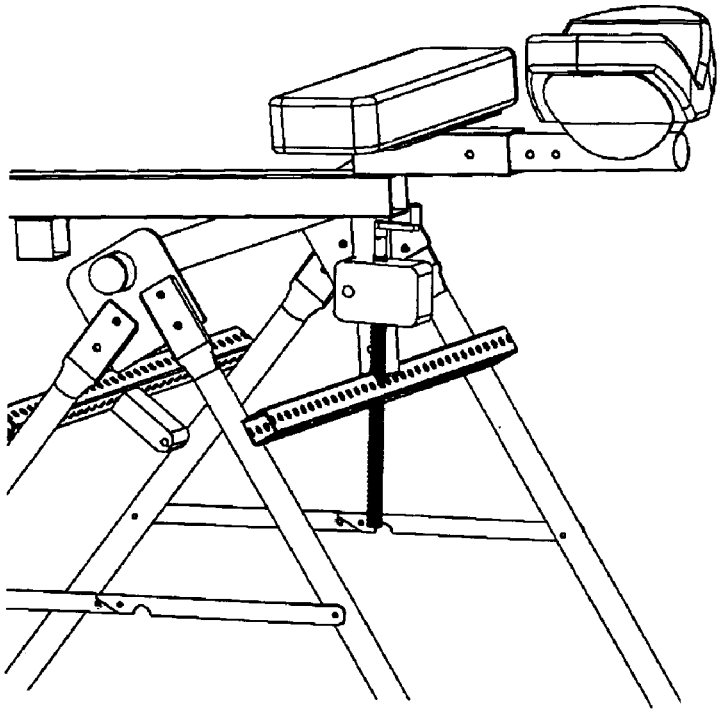

11. FIG. 14A is a perspective view showing an alternative embodiment of a crank with a screw in place of the hydraulic cylinders to control the angle. FIG. 14B is a close up perspective view of the same.

Figure 16A:
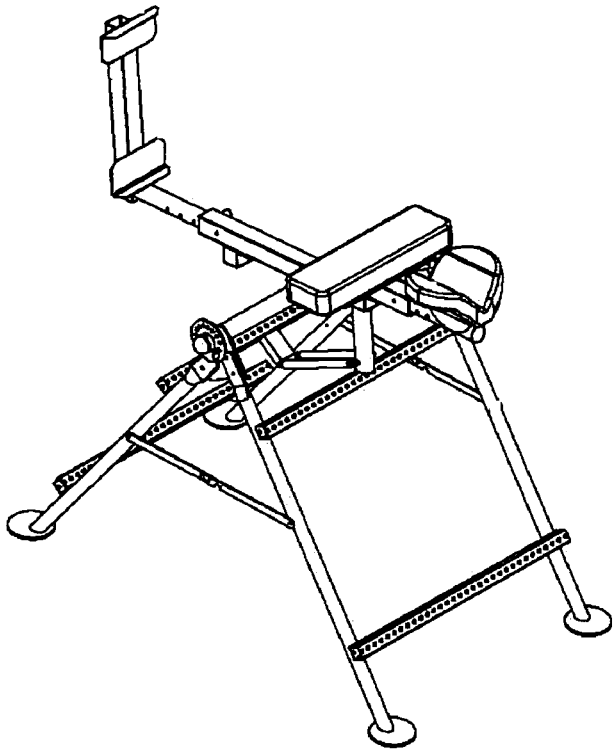
Figure 16B:
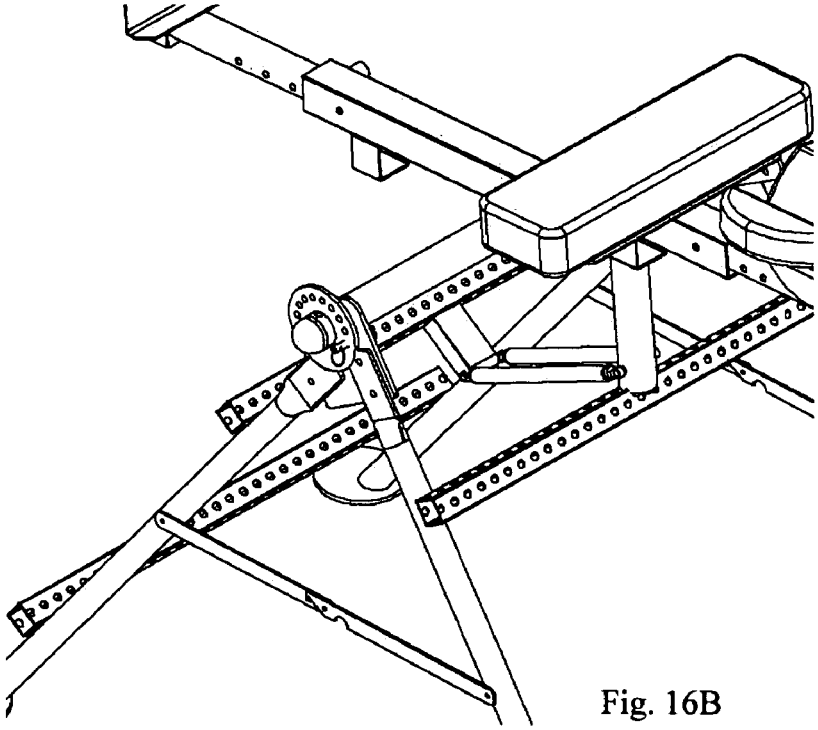

12. FIG. 16A is a perspective view showing an alternative embodiment of a shear pin arrangement in place of the hydraulic cylinders to control the angle. FIG. 16B is a close up perspective view of the same.

13. FIGS. 18A-18D are perspective views showing additional embodiments of ceiling mount bases and wall mount bases.

Figure 22A:
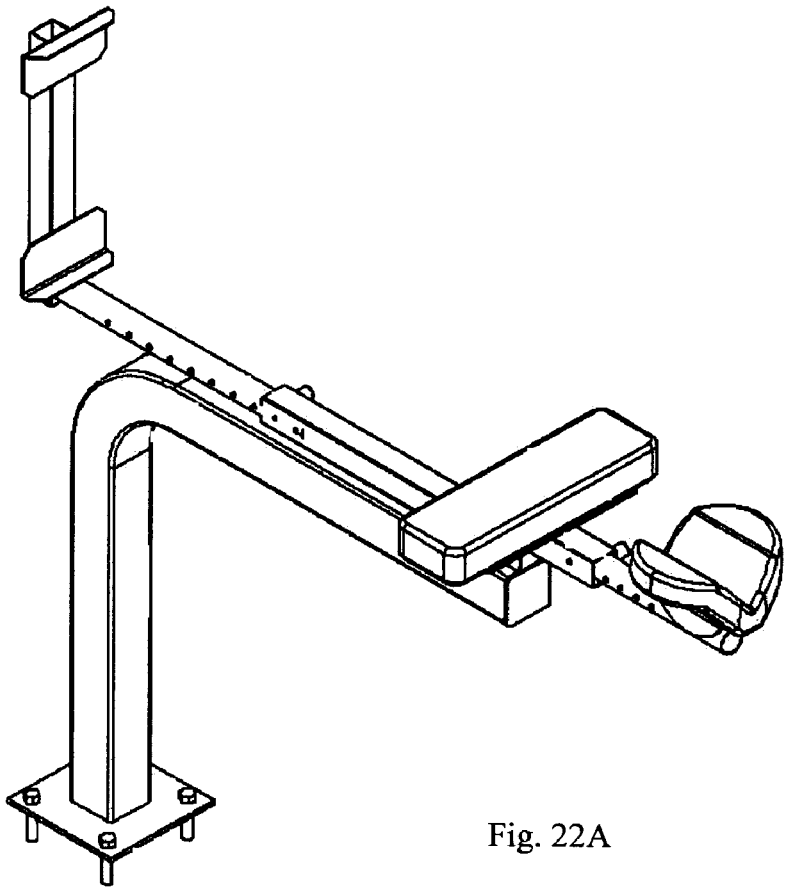
Figure 22B:
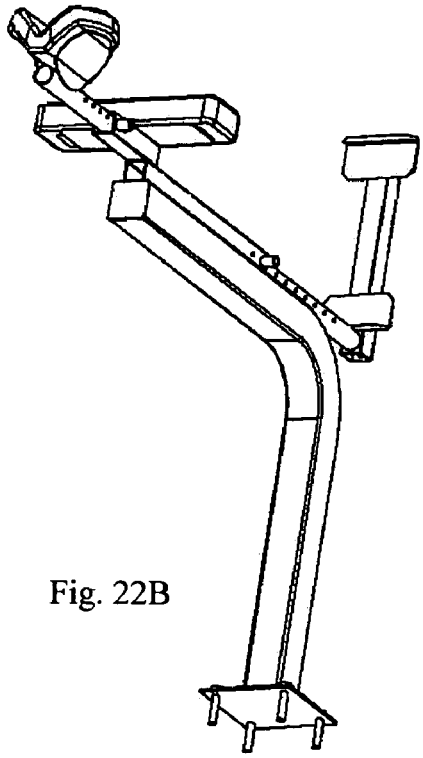

14. FIG. 22A is a perspective view showing an alternative embodiment of a fixed base to the floor with a fixed body support in the horizontal position. FIG. 22B is a perspective bottom view of the same.

Figure 24A:
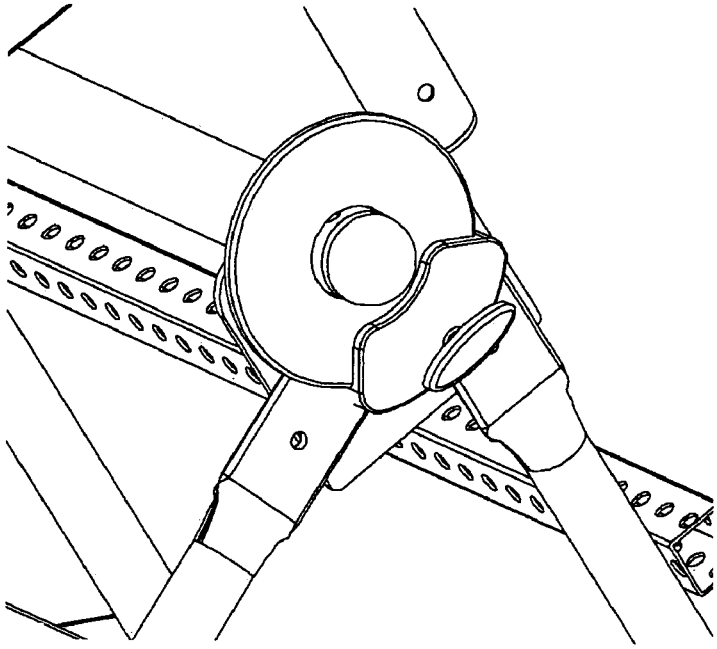
Figure 24B:
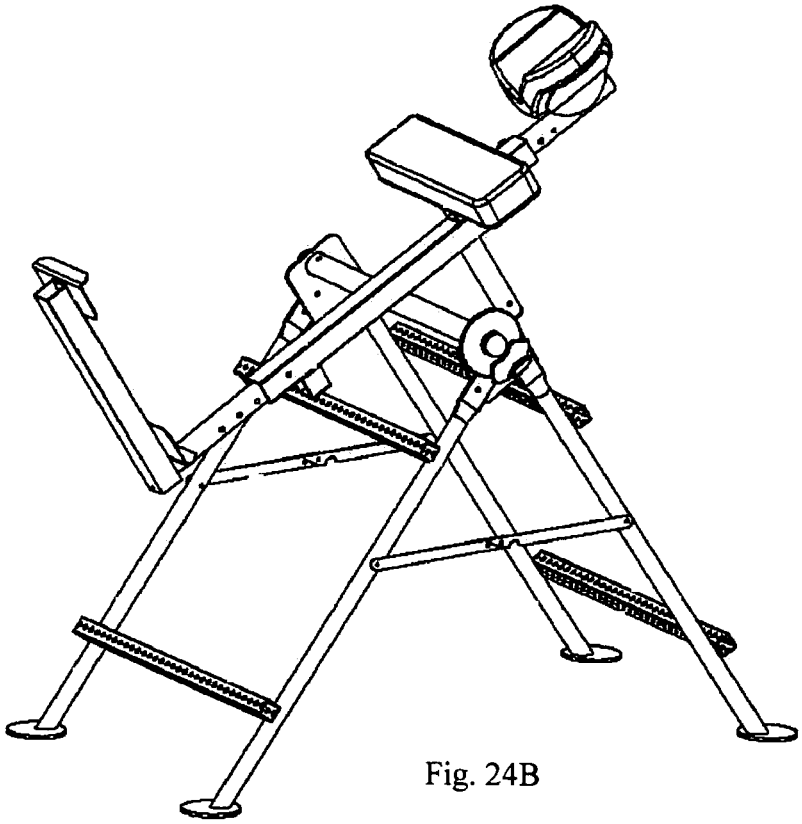

15. FIG. 24A is a close up perspective view showing an alternative embodiment of a caliper style friction brake. FIG. 24B is a full perspective view of the same.

DETAILED DESCRIPTION

Preferred Embodiment

FIGS. 2-6 and FIG. 8

There are five main assemblies to the positioner. The Base which folds up, like a step ladder, when stored, FIG. 2, and unfolds about a single center of rotation 200, when in use, FIG. 3. The Hip Support 22 which incorporates a cushion and plate for resting the hip on as well as the main axis shaft about which the athlete rotates. The Foot Support 20 which telescopes inside the lower tube of the Hip Support 22, adjusts to the athlete's height, and locks in place with a spring loaded shear pin 30. The Chest Support 24 which is also cushioned, telescopes to the length from the hip to the under arm and chest area of the athlete, and locks in place with a spring loaded shear pin 30. And lastly, the Hydraulic Cylinders 26L, 26R that control the rate of rotation and the position of the athlete.

The Base is comprised of four legs 52, four cross braces 54 welded to the legs, four folding tensile members 58,62, and two Bearing Plates 50 which are riveted to the legs 52. Two of the legs, that share a common side, are free to rotate about a common axis rivet to fold for storage, FIG. 2, and unfold for use, FIG. 3. The Bearing Plates 50 have an oversize hole to receive the Hip Support 22.

The Hip Support 22 is made up of two square tubes which have inner dimensions larger than the diameter of the telescoping Foot Support and Chest Support. The upper tube 88 and lower tube 80 are welded together to form the body of the Hip Support. A shaft 82 is welded to the underneath the lower tube which gets mounted into the holes on the Bearing Plates 50 and secured in place by two shear pins 30.

A cushion 90 is secured to the hip plate 84 by hook and loop Velcro.

The Foot Support has two foot plates 70 on which to stand, with 90° lips to take a side force, which results upon rotation. The telescoping tube 74 is perforated and connects to the Hip Support 22 by use of shear pin 30 to accommodate user heights from 4'10" to 6'4".

The Chest Support has two plates 102L and 102R that are angled and spaced to accommodate the chest and clear the latisimus dorsi muscle and allow it free range of motion. The plates are padded 104 to prevent high pressure, and discomfort. The tube 100 is perforated so along with the locking pin 30 the assembly can accommodate varying heights from the hip to the under arm chest area.

The Hydraulic Cylinders are two oil filled cylinders 26L and 26R, two rod ends on each cylinder and two mating clevis pins 32 which are retained by two hair pins 34, and a mount block 28 which is bolted by bolts 40 to Cross Brace 54.

OPERATION

Preferred Embodiment

FIGS. 1A-1E and FIGS. 3-8

The Base, FIG. 3, is unfolded to the extreme position the Folding Tensile members 58, 62 allow. Stops 60 limit the Folding Tensile Members 58, 62 from over extending. The shaft 82 of the Hip Support 22 is installed in bores of the Bearing Plates 50 and secured in position by two pins 30. The Hydraulic Cylinders 26L, 26R are attached to the Base Cross Member 54 by bolts 40 into the Mount Block 28. Foot Support 20 is installed into the Lower 80 of Tube Hip Support 22 and secured at a distance that corresponds to the players foot-to-hip distance with shear pin 30.

The Chest Support 24 is installed into the Upper Tube 88 of Hip Support 22 at a distance that corresponds to the players hip-to-under arm distance and secured in place with shear pin 30. Once assembled, the center of gravity of the top assembly is located on the foot side of the axis shaft 82 so the assembly rotates to the foot end and comes to rest on cross bar 54, reference FIG. 6.

The athlete, equipped with bat, racquet or other element to be swung, steps up on the device FIG. 1A and leans back so his hip is resting on the Hip Cushion 90 and his chest is resting on the Chest Cushion 104 FIG. 1B. The combined center of mass of player, bat or racquet, and device is eccentric to the center of rotation of the Axis Shaft 82, towards the head-end. The resulting eccentric force creates a moment so the player rotates over at a slow rate, controlled by hydraulic cylinders 26L, 26R or other resistive device, to the horizontal position or any desired position in between set by changing Stop length 86. The acceleration due to gravity is a constant, in magnitude, and in a direct, downward direction. A direct downward force acts on the bat, racquet or other instrument being swung FIG. 1C. This resistance can be adjusted by altering the mass of the bat or changing the angle of rotation. The athlete swings his instrument of choice through the resistance, exercising the muscle groups involved in swinging. The athlete can then rotate his body through a second horizontal axis, Axis 2 FIG. 1B to work the specific arc length range of the swing most resisted by gravity. FIG. 1D and FIG. 1E shows the athlete rotated 180° to work the start of a baseball swing, the arc of the swing that fights start up inertia. The athlete can also Stop in mid-swing and perform wrist torque exercises by forcing upward with top hand and downward with bottom hand through short quick strokes.

All swing exercises can be performed with one arm only to further focus the effort. Starting off slow and with light weight, persisting with regular work outs, and gradually increasing the resistance, over time the muscle groups used in swinging build up strength. This enables the player to increase bat speed and to increase and the bat mass which in turn increases the energy available during impact bat on ball. If the ball is impacted properly, with the increased bat speed and the increased bat mass, the ball will travel faster and farther.

For transport and storage, the base folds up to a flat position and the telescoping supports separate by removing spring pins 30.

DESCRIPTION

Additional Embodiments

FIGS. 10A, 10B, 18A-18D

FIGS. 10A and 10B are perspective views showing a Foot Support with the Foot Plates 90° to the original position. This facilitates an overhead swing from a supine position such as to work on an overhead serve with a tennis racquet.

Figure 18A:
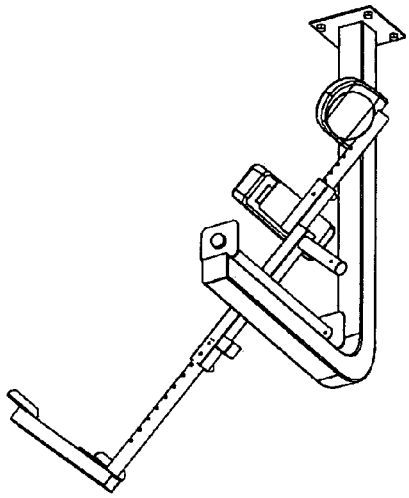
Figure 18B:
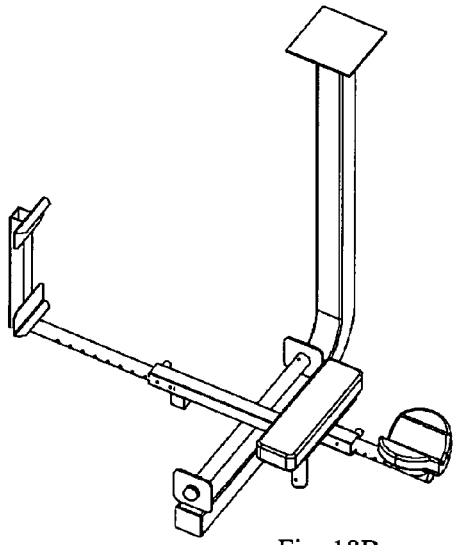

FIGS. 18A and 18B are perspective views showing how the base could be mounted from overhead to save floor space or if the floor is of insufficient strength.

Figure 18C:
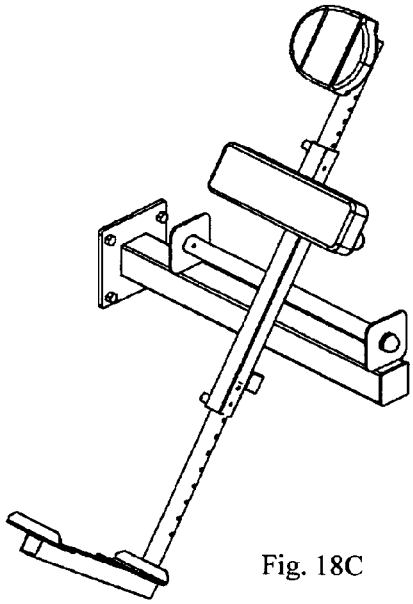
Figure 18D:
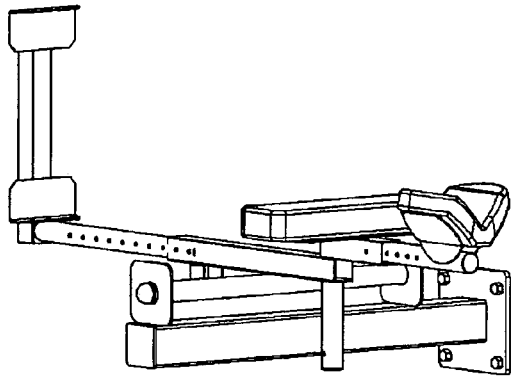

FIGS. 18C and 18D are perspective views showing how the base could be mounted to a wall member of sufficient strength or vertical column.

DESCRIPTION

Alternative Embodiments

FIGS. 12A-12C, 14A, 14B, 16A, 16B, 20A-20C, 24A, 24B

The Hip Support could be permanently joined to the Base in an advantageous angle off vertical for working the swing such as the horizontal position, which is the position that the direct downward resistant force on the implement is maximum. The Base could be stationary and permanently fixed to the floor at a set position, making it no longer folding or portable. Fewer moving parts would reduce cost and simplify the design as shown in FIGS. 22A and 22B. This cantilevered style would also facilitate the down-to-up swing as in training to drive a golf ball and make a slapshot in ice hockey and field hockey.

There are several alternatives to adjusting and locking the angular adjustment with respect to vertical other than the hydraulic cylinders. In FIGS. 12A, 12B, and 12C are perspective views showing an electric motor to adjust the angle. Further switches and a wireless remote could be added so the angle could be adjusted more conveniently.

FIGS. 14A and 14B show a hand crank on the end of a drive screw which is a cheaper possibility for setting and locking the angle. Perhaps the least expensive is the shear pin in mating female holes as shown in FIGS. 16A and 16B. A common caliper style brake and rotor or other friction device could be substituted for the shear pin as in FIGS. 24A and 24B.

The exercise method and machinery means permit not only working out to improve swing speed of sporting implements and self defense implements but also permit military and police training and working out for offensive weapons such as clubs, swords or bayonets.

Although the description above contains many specificities, these should not be construed as limiting the scope of the exercise method and apparatus means but as merely providing illustrations of some of the presently preferred embodiments of this invention. Many other ramifications and variations are possible within the teachings of the invention. The scope of the invention should be determined by the appended claims and their legal equivalents, rather than by the examples given.

I claim:

1. A method of exercising a users arm for increasing swing speed and swing strength by suspending an exerciser on a device in a lateral position and the exerciser simultaneously swinging a implement device with the arm, comprising the steps of:

(a) providing a support device sized and configured to support the exerciser lying down in said lateral position; said support device including a support surface, (b) providing a clear path for the exerciser to swing said implement device in a forward and back arc motion;

(c) providing a base structure to mount said support device, said base having a height dimension greater than a length dimension of said implement being swung;

(d) providing means for controllably adjusting an angular incline of said base;

(e) providing means for attaching said support device to said base structure, whereby said implement is swung against a resistance.

* * * * *